United States Patent [19]

Korthaus

[11] Patent Number: 4,844,687

[45] Date of Patent: Jul. 4, 1989

[54] SELFPRIMING CENTRIFUGAL PUMP

[76] Inventor: Ernst Korthaus, Hoddenfeld 21, 4600 Dortmund 46, Fed. Rep. of Germany

[21] Appl. No.: 181,396

[22] Filed: Apr. 14, 1988

[30] Foreign Application Priority Data

Apr. 16, 1987 [DE] Fed. Rep. of Germany ..... 3712916

[51] Int. Cl.[4] ..... F04D 9/02

[52] U.S. Cl. ..... 415/56.1; 415/56.3; 415/208.2

[58] Field of Search ..... 415/209, 210, 211, 216, 415/217, 121 A, 168, 52, 53 R

[56] References Cited

U.S. PATENT DOCUMENTS

| | | | |
|---|---|---|---|
| 2,247,817 | 7/1941 | McMahan | 415/211 |
| 2,461,925 | 9/1946 | Rupp | 415/53 R |
| 2,945,448 | 7/1960 | Frederick | 415/211 |
| 3,103,177 | 9/1963 | Gatto et al. | 415/211 |
| 3,873,231 | 3/1975 | Callahan | 415/211 |
| 4,401,409 | 8/1983 | Torbica et al. | 415/211 |

FOREIGN PATENT DOCUMENTS

| | | | |
|---|---|---|---|
| 673662 | 3/1939 | Fed. Rep. of Germany . | |
| 959969 | 3/1957 | Fed. Rep. of Germany . | |
| 7534163 | 3/1976 | Fed. Rep. of Germany . | |
| 3539883 | 3/1987 | Fed. Rep. of Germany . | |
| 2405083 | 6/1979 | France | 415/168 |
| 987189 | 1/1983 | U.S.S.R. | 415/168 |
| 856886 | 12/1960 | United Kingdom | 415/211 |
| 974971 | 11/1964 | United Kingdom | 415/211 |

OTHER PUBLICATIONS

"Die Pumpen" by Fuchslocher/Schulz, 1963, pp. 187 to 189, Springer-Verlag, Berlin/Göttingen/Heidelberg.

"Strömungsmaschinen" by Pfleiderer/Petermann, 1972, pp. 316 to 319, Springer-Verlag Berlin Heidelberg, New York.

*Primary Examiner*—Robert E. Garrett
*Assistant Examiner*—John T. Kwon
*Attorney, Agent, or Firm*—Walter Ottesen

[57] ABSTRACT

The invention is directed to a selfpriming centrifugal pump having a symmetrical annular guide channel with a centrally mounted cover disc. A pair of guide ribs improve the loading of the impeller and increase the capacity for drawing air by suction. The guide rib pair is mounted in the annular guide channel. Each guide rib includes an injection rib and a separation rib. The ribs preferably have a width corresponding to the width of the annular guide channel and are arranged on a secant drawn through the circular peripheral band defined by the outer tips of the vanes of the impeller as the latter rotates.

7 Claims, 4 Drawing Sheets

SELFPRIMING CENTRIFUGAL PUMP

FIELD OF THE INVENTION

The invention relates to a selfpriming centrifugal pump having an impeller and a rotation-symmetrical annular guide channel. The centrifugal pump further includes at least one cover disc and a central suction line. The centrifugal pump is especially suitable for pumping sewage. Pumps of this kind operate pursuant to the principle described in the text "Die Pumpen" by Fuchslocher and Schulz, Springer Verlag, New York, pages 187 to 189, (1963).

BACKGROUND OF THE INVENTION

It is a requirement of selfpriming centrifugal pumps that the gas pocket present in the suction line be drawn off by suction as quickly as possible and be pushed out via the pressure line.

A pump having a smooth annular guide channel is disclosed in the text entitled "Strömungsmaschinen" by Pfleiderer and Petermann, Springer Verlag, New York (1972), page 316. The smooth annular guide channel has lateral rotational surfaces and one of the two lateral rotational surfaces is as a rule the cover disc which is mountable and demountable whereas the other rotational surface is the housing wall. The value of a smooth annular guide channel is dependent exclusively upon its radial extent and is not dependent upon whether it becomes wider or narrower toward the outside thereof.

German utility model registration DE-GM No. 75 34 163 discloses a centrifugal pump for pumping liquids mixed with gases wherein a guide body is mounted so as to be tangent-like to the impeller in the guide channel. The gas/liquid mixture is not adequately skimmed away from the impeller. This mixture remains for longer periods of time in the chamber of the impeller and becomes heated.

German published patent application DE No. 35 39 883 A1 discloses a selfpriming centrifugal pump in the form of a multi-stage embodiment wherein the last stage has a separation chamber associated therewith. At least one guide surface and a diffuser collector nozzle corresponding thereto are mounted in the lead apparatus in addition to a plurality of guide vanes. Only an inadequate return of water to the impeller takes place and therefore a flushing of air or gas into the impeller occurs. This condition is present because of the many guide vanes and the configuration of the guide surface with the diffuser collector nozzle.

SUMMARY OF THE INVENTION

In view of the above, it is an object of the invention to provide a selfpriming centrifugal pump of the above-mentioned type wherein the drag effect of the operating water on the gas volume which is present and which is to be pumped out is increased.

The selfpriming centrifugal pump of the invention is for pumping an operating liquid such as sewage. The centrifugal pump includes: a pump housing for receiving an operating liquid therein; a suction branch which is vented when the pumping action is initiated; a discharge branch; an impeller rotatably mounted in the housing for rotation in a predetermined direction and so as to be disposed in the operating liquid when the latter is contained therein and for moving the operating liquid to be pumped from the suction branch to the discharge branch after the suction branch is vented; drive means for rotatably driving the impeller; two mutually adjacent walls arranged on respective sides of the impeller to define a rotationally-symmetrical annular guide channel communicating with the suction branch; the impeller having a plurality of vanes with respective outer tips tracing an imaginary circular peripheral band as the impeller rotates in the housing, each two mutually adjacent ones of the vanes conjointly defining an impeller cell; guide means including two ribs having respective end edges, the ribs being mounted in the guide channel so as to place the end edges thereof on a secant drawn through the circular peripheral band near the intersections of the secant with the circular peripheral band; the ribs being further mounted in the guide channel so as to permit the outer tips and the edges to conjointly define a predetermined clearance therebetween as the vanes rotate past the ribs; a first one of the ribs being an injection rib positioned with respect to the direction of rotation of the impeller so as to cause a portion of the operating liquid in the guide channel to be directed back into the cells of the impeller to there establish a liquid/air mixture to draw air out of the suction branch to vent the latter; and, the second one of the ribs being a separation rib for separating a part of the liquid/air mixture flung into the guide channel into a liquid component and an air component so as to allow the air component to escape upwardly in the housing and to permit the separated liquid component to be directed back into the impeller cells by the injection rib as the liquid component is rotated with the impeller.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
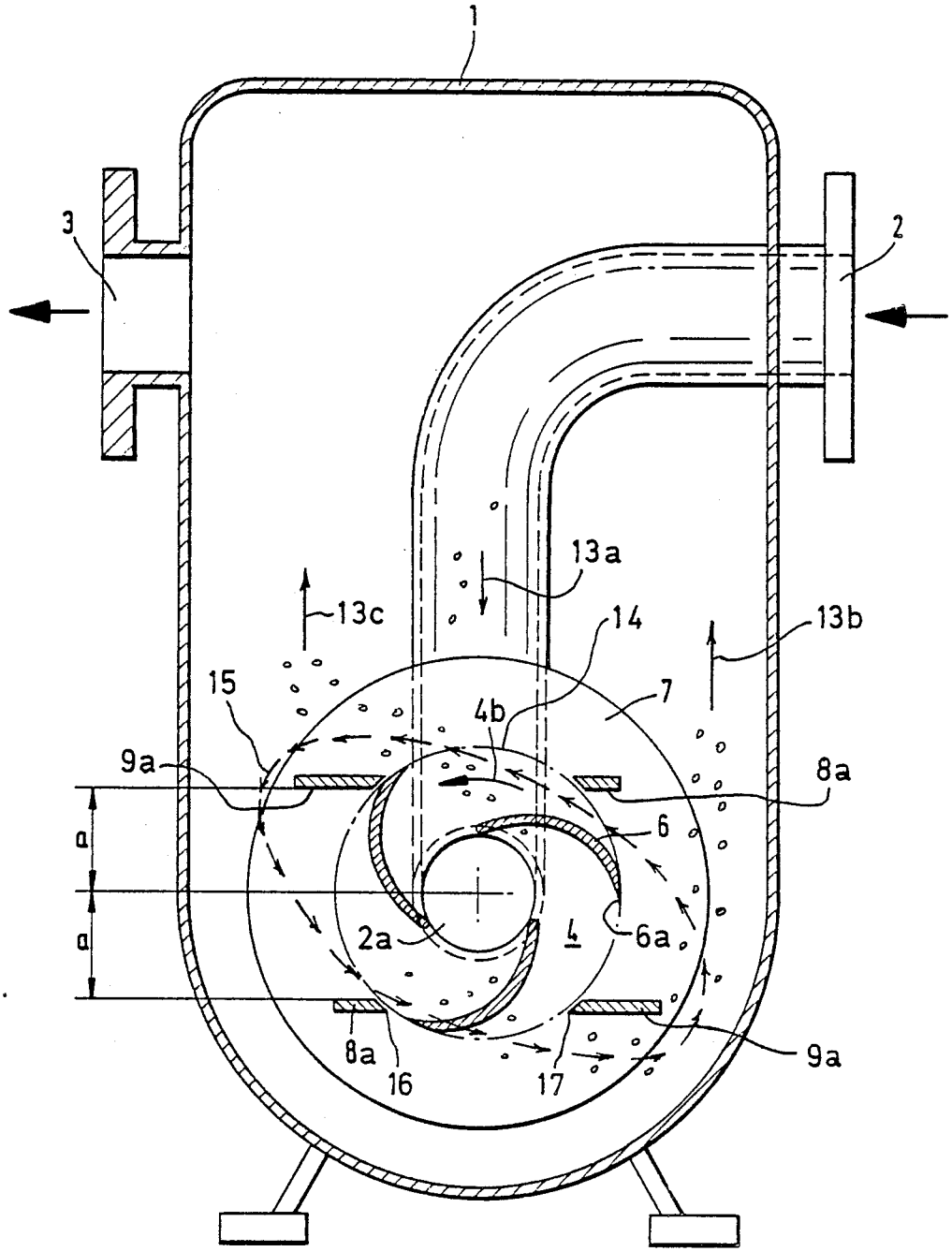
FIG. 1 is an elevation view, in section, of a selfpriming centrifugal pump with the view being taken through the center plane of the impeller.

In FIG. 1, the suction branch 2 and the discharge branch 3 enter the pump housing 1 above the axis 4*a* of the impeller 4. Accordingly, this assures that the pump housing 1 does not run dry when the pump is at standstill. The impeller 4 is surrounded by a rotational-symmetrical open annular guide channel 5. The vanes 6 of the impeller 4 are arcuately bent backwards as shown and each two mutually adjacent ones of the vanes conjointly define an impeller cell. The cover disc 7 includes two guide rib pairs (8*a*, 9*a*) of which one pair is above the impeller axis 4*a* and the other pair is beneath this axis. The guide rib pairs (8*a*, 9*a*) include an injection rib 8*a* and a separation rib 9*a* which are welded to the cover disc 7 in the embodiment shown.

The injection rib 8*a* and the separation rib 9*a* are linear and are of different lengths and lie on a secant of the cover disc 7. The ribs (8*a*, 9*a*) are positioned in the guide channel 5 so as to place the respective end edges (16, 17) thereof very close to the points at which the secant intersects the imaginary circular peripheral band 14 traced by the outer tips 6*a* of the vanes 6 as the impeller 4 rotates about its rotational axis 4*a*.

The second pair of guide ribs are located on the secant disposed at the same distance (a) from the impeller axis 4*a* as the first pair of guide ribs. The guide rib pairs (8*a*, 9*a*) are arranged in the form of an equilateral triangle when three pairs thereof are utilized. Here too, the injection rib and the separation rib are mounted in the guide channel 5 so that they are very close to the outer tips of the impeller vanes 6 as they rotate about the axis 4*a*.

The injection rib 8*a* guides a portion of the operating water rotating in the guide channel 5 back into the cells of the impeller 4. This action of the injection rib 8*a* is produced because of its special angular position vis-a-vis direction 4*b* of rotation of the impeller 4. The injection rib effectively injects water into the impeller cells and causes a water/air mixture to form therein. Thus, air entering the cells from the central region 2*a* mixes with water injected into the cells by the injection ribs 8*a*. The water/air mixture formed in the impeller draws air from the suction branch 2 and thereby brings about a ventilation of the suction line.

The centrifugal force causes the water/air mixture to be flung out into the annular guide channel 5. The action of the separating ribs 9*a* then causes a portion of the water/air mixture flung into the annular guide channel 5 to be separated into water and air. The air escapes upwardly as shown in FIG. 1 and is identified by reference numerals (13*b*, 13*c*). The air drawn into the impeller 4 during venting of the suction branch 2 is identified in FIG. 1 by reference numeral 13*a*.

On the other hand, the component of water which is separated by the separating ribs 9*a* is recaptured and returned into the impeller 4 by the injection ribs 8*a*. The movement of the portion of the water moved in this manner is indicated in FIG. 1 by the arrows identified by reference numeral 15. The ribs cause a high-speed flow of water to move along an elliptical path thereby continuously generating the water/air mixture which enables the suction branch 2 to be vented. The upwardly moving air separated by the separation ribs 9*a* is indicated by arrows (13*b*, 13*c*) and is conducted away from the pump housing 1 via the discharge branch 3 so that the centrifugal pump will quickly pump the operating liquid which can, for example, be sewage.

As described above, the injection ribs (8*a*) cause the operating water in the pump housing 1 to move with high velocity back into the cells of the impeller 4. The primary effect of this action is the formation of the water/air mixture in the impeller cells which produces an excellent venting of air or gas from the suction branch 2 and the suction line connected thereto. This also results in a reduced heating of the operating water so that the time permitted for venting the suction branch 2 and the suction line associated therewith is extended. Furthermore, the pump can run a longer period of time before the operating water begins to cook and greater lengths of suction lines can be vented. After venting is complete, the operating liquid to be pumped enters the impeller via the suction branch and is pumped out via the pressure branch 3.

Figure 2:
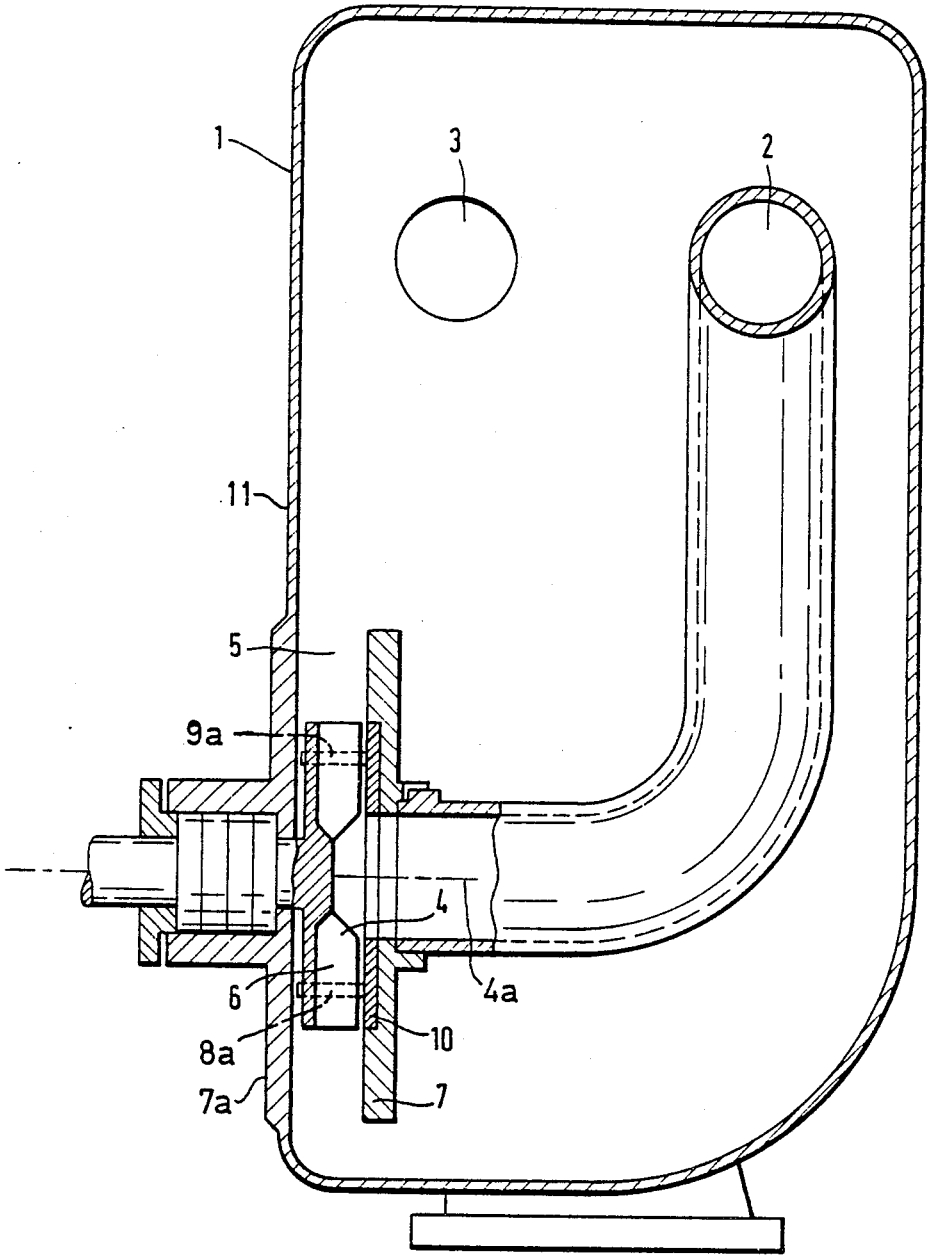
FIG. 2 is another elevation view, in section, of a selfpriming centrifugal pump according to the invention with the section view being taken along the longitudinal axis of the impeller drive shaft.

FIG. 2 shows additional construction details of the centrifugal pump according to the invention. The impeller 4 is open on one side and it is covered in a seal-like manner by the cover disc 7 at the other side as shown. The cover disc 7 can be provided in its central region with an exchangeable wearing disc 10. In the embodiment shown, the second wall of the annular guide channel 5 is defined by the widened portion 7*a* of the housing wall 11 at the drive side of the impeller 4. As shown in FIG. 2, the ribs (8*a*, 9*a*) have a width so that they extend across virtually the entire annular guide channel 5.

Figure 3:
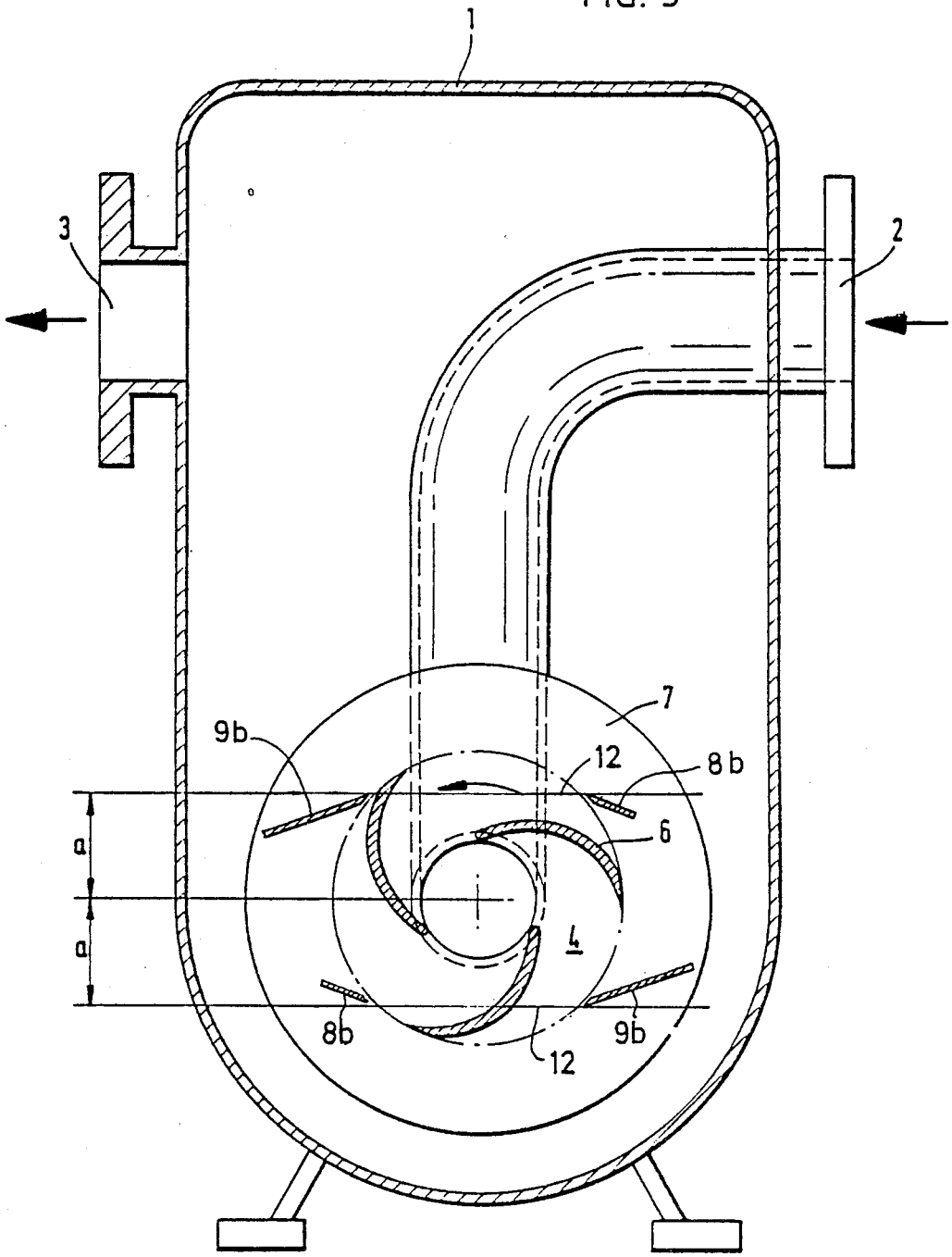
FIG. 3 is a section view corresponding to that of FIG. 1 except that here the impeller assembly is equipped with injection and separation ribs which are inclined at an angle with respect to a secant passing through the circular peripheral band defined by the outer tips of the vanes of the impeller as it rotates; and, FIG. 4 is a view corresponding to that of FIG. 1 except that here the injection rib and the separation rib are shown as arcuate members.
Figure 4:
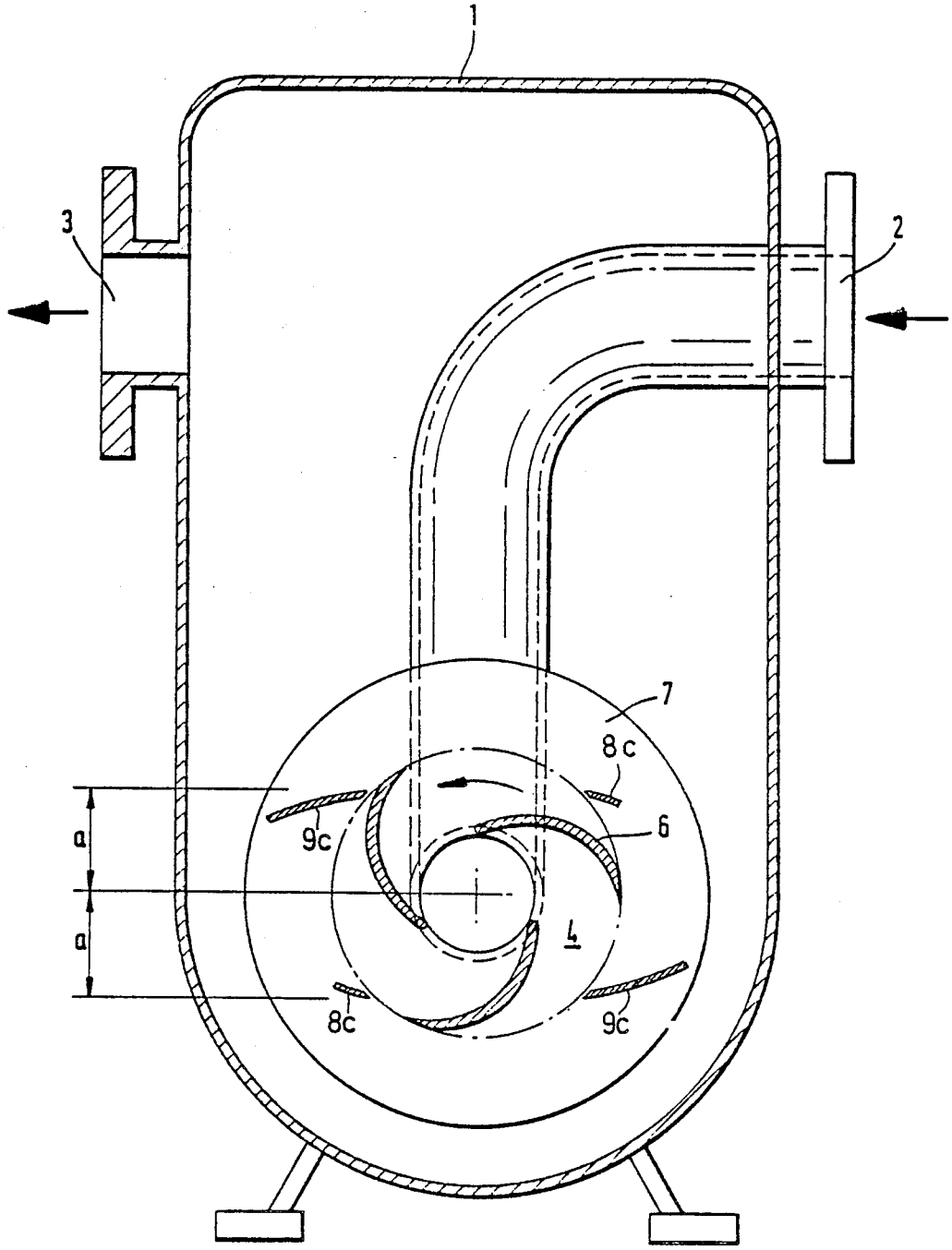

FIG. 3 shows an alternate embodiment of the guide ribs (8*b*, 9*b*) which are linear and are inclined with respect to the secant lines 12. On the other hand, FIG. 4 shows another embodiment of the invention wherein the guide ribs (8*c*, 9*c*) are of arcuate configuration. However, the best compromise between venting capacity and the overall efficiency of the pump is achieved with the ribs positioned as shown in FIGS. 1 and 2.

It is understood that the foregoing description is that of the preferred embodiments of the invention and that various changes and modifications may be made thereto without departing from the spirit and scope of the invention as defined in the appended claims.

What is claimed is:

1. A selfpriming centrifugal pump for pumping an operating liquid, the centrifugal pump comprising:

a pump housing for receiving an operating liquid therein;

a suction branch which is vented when the pumping action is initiated;

a discharge branch;

an impeller rotatably mounted in said housing for rotation in a predetermined direction and so as to be disposed in the operating liquid contained therein for pumping the latter from said suction branch to said discharge branch after the suction branch is vented;

drive means for rotatably driving said impeller;

two mutually adjacent walls arranged on respective sides of said impeller to define a rotationally-symmetrical annular guide channel communicating with said suction branch;

said impeller having a plurality of vanes with respective outer tips tracing an imaginary circular peripheral band as the impeller rotates in said housing, each two mutually adjacent ones of said vanes conjointly defining an impeller cell;

guide means including two ribs having respective end edges, said ribs being mounted in said guide channel so as to place said end edges thereof on a secant drawn through said circular peripheral band near the intersections of said secant with said circular peripheral band;

said ribs being further mounted in said guide channel so as to permit said outer tips and said edges to conjointly define a predetermined clearance therebetween as said vanes rotate past said ribs and so as to extend away from said predetermined clearance in respective directions which are substantially opposite to each other;

a first one of said ribs being an injection rib positioned with respect to the direction of rotation of the impeller so as to direct a portion of said operating liquid in said guide channel back into the cells of the impeller to there establish a liquid/air mixture to draw air out of said suction branch to vent the latter;

the second one of said ribs a separation rib for separating a part of the liquid/air mixture flung into said guide channel into a liquid component and an air component so as to allow the air component to escape upwardly in said housing and to permit the separated liquid component to be directed back into the impeller cells by said injection rib as said liquid component is rotated with said impeller; and, said injection rib and said separation rib having respective lengths, one of said lengths being greater than the other one of said lengths.

2. The selfpriming centrifugal pump of claim 1, said ribs being linear and mounted in said guide channel so as to lie on said secant.

3. The selfpriming centrifugal pump of claim 1, said ribs being linear and mounted in said guide channel so as to be inclined with respect to said secant.

4. The selfpriming centrifugal pump of claim 1, said ribs being arcuate along their respective lengths.

5. The selfpriming centrifugal pump of claim 1, said two ribs being a first pair of ribs and said guide means comprising a plurality of said pairs of ribs arranged on respective secants drawn through said circular peripheral band.

6. The selfpriming centrifugal pump of claim 1, said ribs being fixedly attached to one of said walls.

7. The selfpriming centrifugal pump of claim 1, said ribs and said end edges thereof having a width corresponding to the width of said annular guide channel.

* * * * *

UNITED STATES PATENT AND TRADEMARK OFFICE

CERTIFICATE OF CORRECTION

PATENT NO. : 4,844,687

DATED : July 4, 1989

INVENTOR(S) : Ernst Korthaus

It is certified that error appears in the above-identified patent and that said Letters Patent is hereby corrected as shown below: Title page:

In the Abstract, line 6, insert -- pair -- after "rib".

In column 5, line 3: insert -- being -- between "ribs" and "a".

Signed and Sealed this

Fifteenth Day of May, 1990

*Attest:*

HARRY F. MANBECK, JR.

*Attesting Officer*

*Commissioner of Patents and Trademarks*